US005709044A

United States Patent [19]

Atapattu

[11] Patent Number: 5,709,044

[45] Date of Patent: Jan. 20, 1998

[54] IRONING BOARD MOUNTING BRACKET

[76] Inventor: Suramya T. Atapattu, 9614 Pondwoood Rd., Boca Raton, Fla. 33428

[21] Appl. No.: 692,920

[22] Filed: Jul. 31, 1996

[51] Int. Cl.[6] ..... D06F 81/06; A47B 5/04

[52] U.S. Cl. ..... 38/103; 38/107; 108/42; 108/134; 248/278.1

[58] Field of Search ..... 38/103, 107, 104, 38/137, 139; 108/4, 7, 10, 47, 48, 50, 134; 248/218.4, 219.2, 278.1, 279.1, 287.1, 284.1

[56] References Cited

U.S. PATENT DOCUMENTS

| | | | |
|---|---|---|---|
| 1,858,765 | 5/1932 | Cramer | 38/107 X |
| 3,185,278 | 5/1965 | Miller et al. | 38/107 X |
| 4,480,556 | 11/1984 | Wilson et al. | 38/103 X |
| 4,729,535 | 3/1988 | Frazier et al. | 248/218.4 X |
| 4,961,388 | 10/1990 | Simpson | 108/48 X |
| 5,271,593 | 12/1993 | Kinner et al. | 248/278.1 X |

*Primary Examiner*—Ismael Izaguirre
*Attorney, Agent, or Firm*—Malin, Haley, DiMaggio & Crosby,PA

[57] ABSTRACT

A wall mounting bracket for an ironing board and iron, comprising an elongated rigid member means for mounting to a wall, said elongated member incorporating a top portion for supporting a hand iron, and bottom portion providing pivotal support for a conventional ironing board, whereby said ironing board is movable from a first position, wherein said ironing board is vertically disposed adjacent to the supporting wall and a second position, whereby said ironing board is horizontally disposed in spaced relation to said supporting wall, said ironing board support further providing for vertical adjustment of said ironing board to a user-selected height.

8 Claims, 5 Drawing Sheets

IRONING BOARD MOUNTING BRACKET

BACKGROUND OF THE INVENTION

1. Field of the Invention

The present invention relates to ironing boards, and more particularly to a novel mounting bracket for an ironing board and iron adapted to be disposed on a planar supporting surface.

2. Description of the Prior Art

Ironing boards are well known in the art for providing a horizontal planar surface upon which wrinkles may be removed from laundry and other fabrics by hand pressing using an ironing means. Conventional ironing boards typically include an elongated planar surface, collapsible and selectively supportable by a plurality of legs. In addition, conventional electric powered hand irons for use with such ironing boards are well known in the art.

In dwellings where square footage is at a premium, it is often difficult to find storage space for a conventional ironing board and hand iron. Furthermore, even in larger dwellings where square footage is abundant, the user is often inconvenienced by having to remove a conventional ironing board from a storage closet, transport it to an appropriate place for use, and thereafter return it to storage. As the prior art discloses, these problems can be avoided or minimized by mounting a folding ironing board on a wall in such a manner that it projects from and is supported by the wall when open, and lies more or less flat against the wall when stored, being manually movable between the open and stored positions.

For example, U.S. Pat. No. 549,932, issued to McKenzie, discloses an ironing board mounting bracket incorporating a flat-iron stand for mounting an ironing board to a wall. U.S. Pat. No. 1,136,878, issued to Hornschuch, discloses a pivotal, wall-mounted ironing board assembly having an ironing board pivotally secured to a recessed wall cabinet, wherein said ironing board is movable from a lowered position to a raised position. U.S. Pat. No. 1,506,240, issued to Ives, also discloses a means for attaching an ironing board to a wall in such a manner that it can be held in a horizontal position when in use or in a vertical position when not in use, thus doing away with the necessity of moving the board from place to place. U.S. Pat. No. 2,568,211, issued to Woelke, discloses an apparatus providing combined mounting for an ironing board and iron.

Applicant's invention improves upon the prior art and provides an ironing board that is mounted along one side and spaced from a wall when in use, thereby freeing up the front end, the rear end, and both longitudinal sides for improved access to the periphery of the ironing board.

SUMMARY OF THE INVENTION

An ironing board mounting bracket, comprising an elongated rigid member providing means for mounting to a wall, said elongated member incorporating a top portion providing means for supporting a hand iron, and bottom portion providing pivotal support means for a conventional ironing board, whereby said ironing board is movable from a first position, wherein said ironing board is vertically disposed adjacent to the supporting wall and a second position, whereby said ironing board is horizontally disposed in spaced relation to said supporting wall, said ironing board support means further providing for vertical adjustment of said ironing board to a user-selected height.

The wall mounting bracket of the instant invention is adapted to receive a conventional ironing board permanently fastened thereto thereby eliminating the need for a specially fabricated ironing board.

It is an object of this invention to provide an improved wall mounting bracket for an ironing board and hand iron combination.

It is another object of this invention to provide an improved wall mounting braket for an ironing bard and hand iron combination capable of storing an ironing board in a first, vertically disposed position substantially adjacent to the supporting wall, and a second, horizontal position wherein said ironing board is spaced from said supporting wall.

In accordance with these and other objects which will become apparent hereinafter, the instant invention will now be described with particular reference to the accompanying drawings.

DESCRIPTION OF THE PREFERRED EMBODIMENTS

Figure 1:
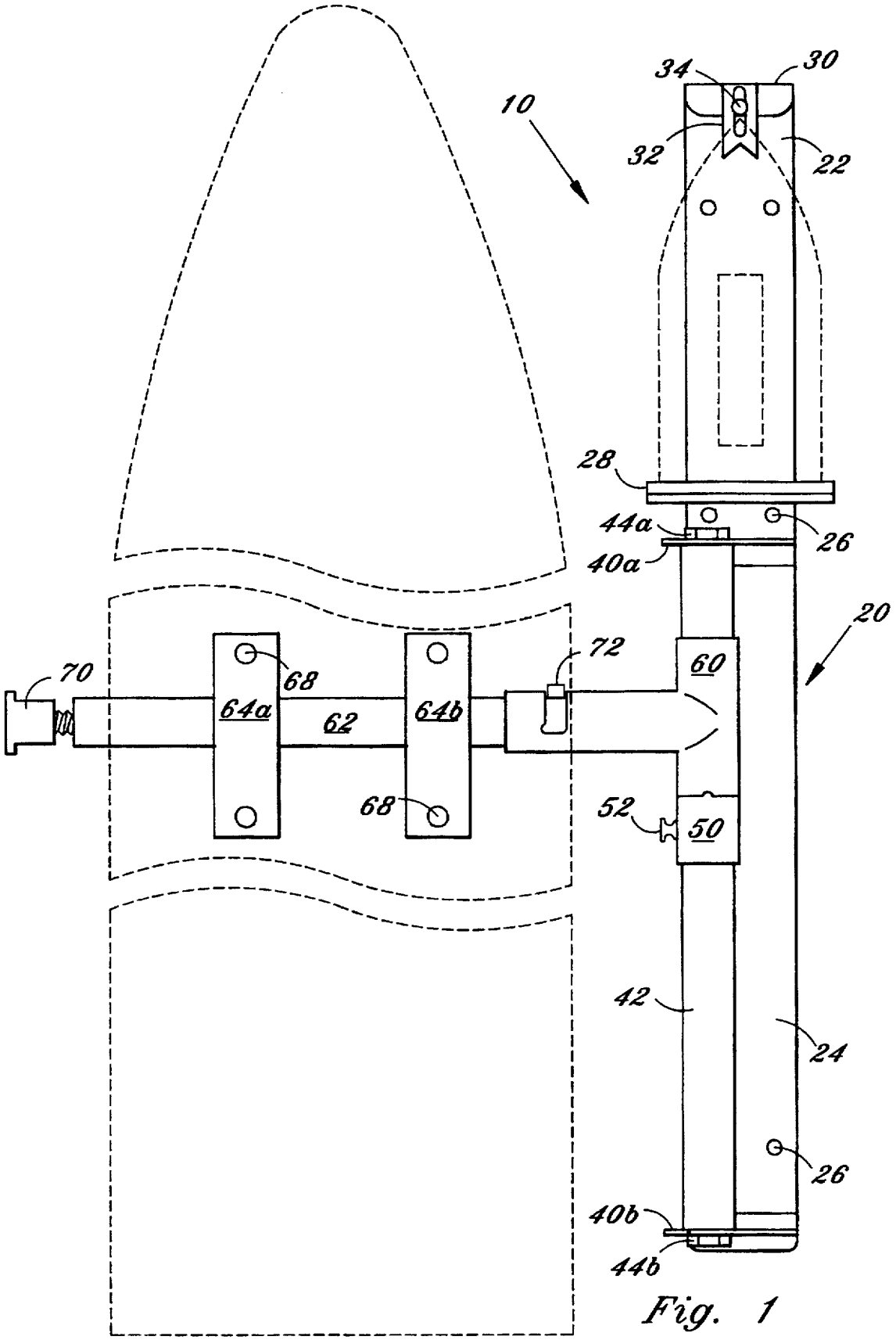
FIG. 1 shows a front elevational view of the present invention with ironing board and iron depicted in phantom.
Figure 2A:
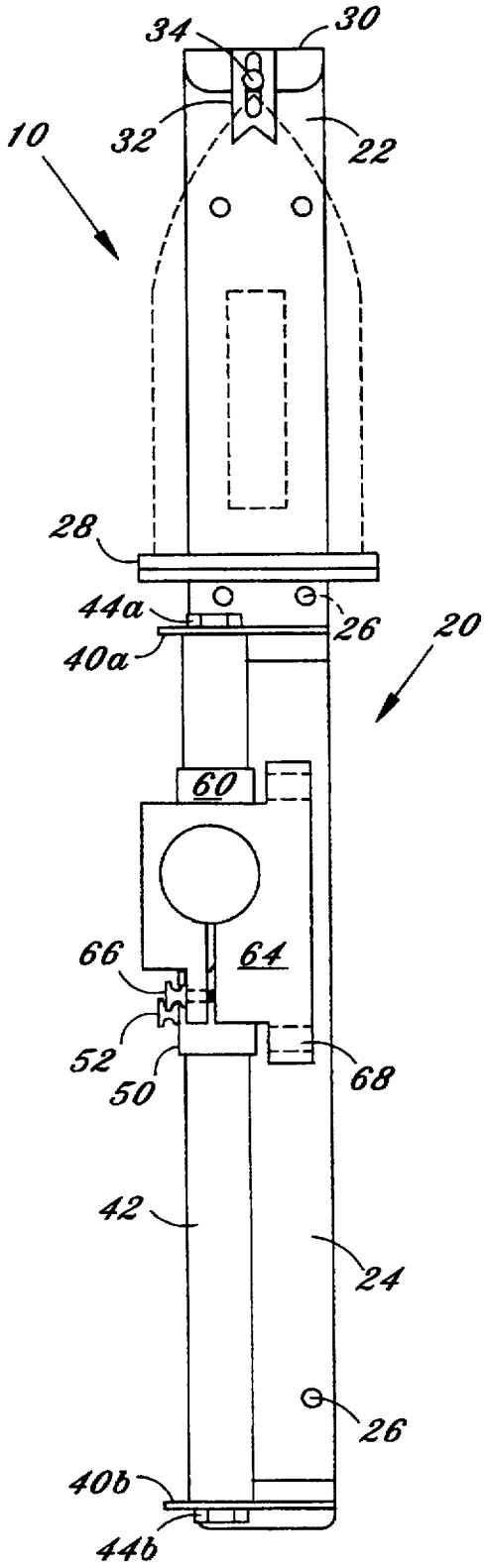
FIG. 2A shows a front elevational view of the instant invention, wherein the ironing board mounting bracket is pivoted away from the supporting wall.
Figure 2B:
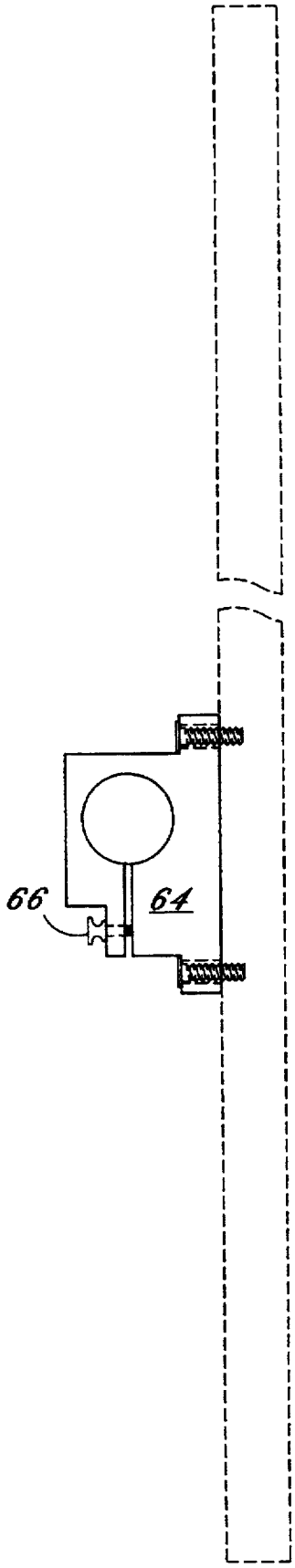
FIG. 2B shows an ironing board in phantom mounted to the support bracket of the instant invention.
Figure 3:
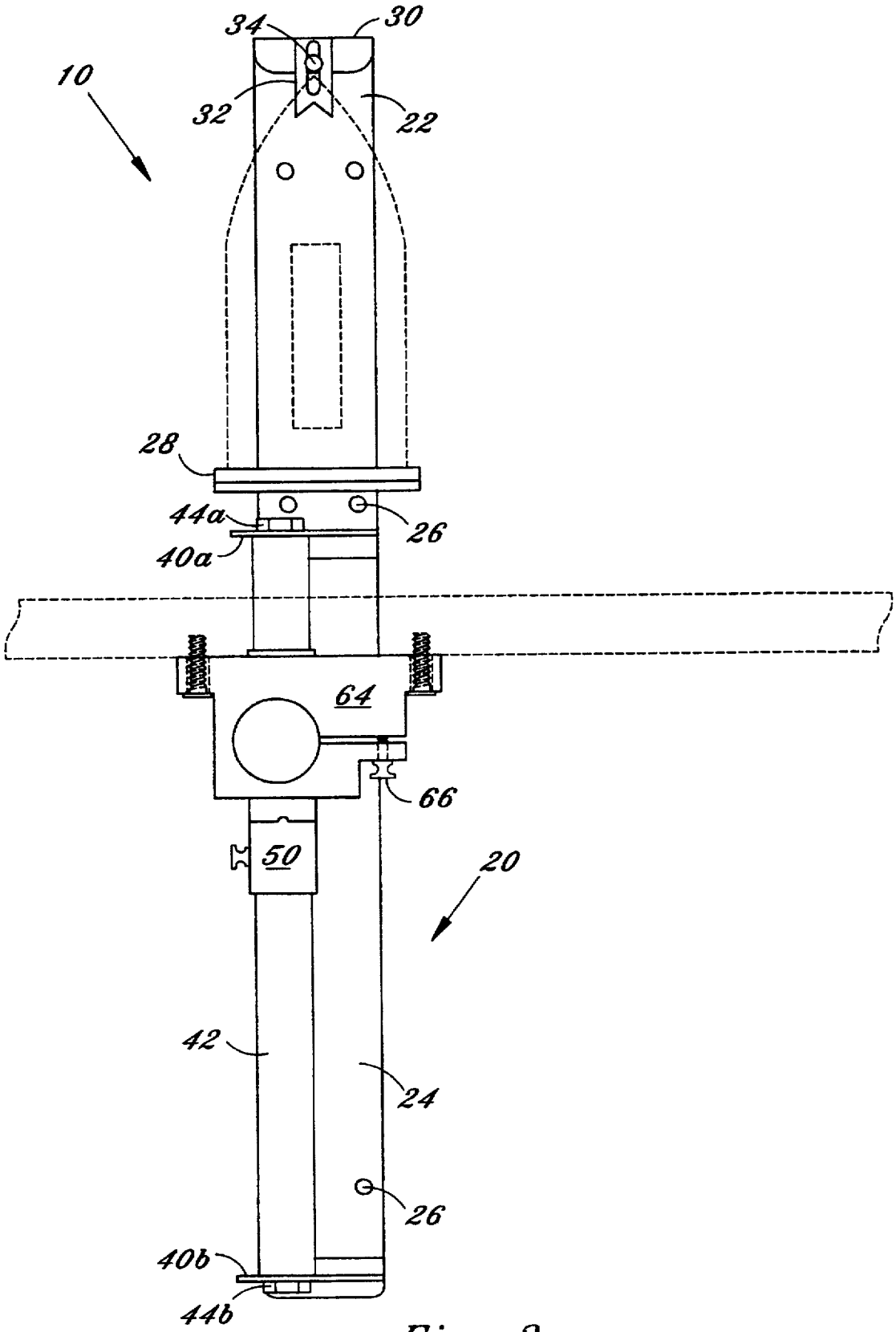
FIG. 3 shows a front elevational view of the instant invention, wherein an ironing board is shown in partial phantom.
Figure 4:
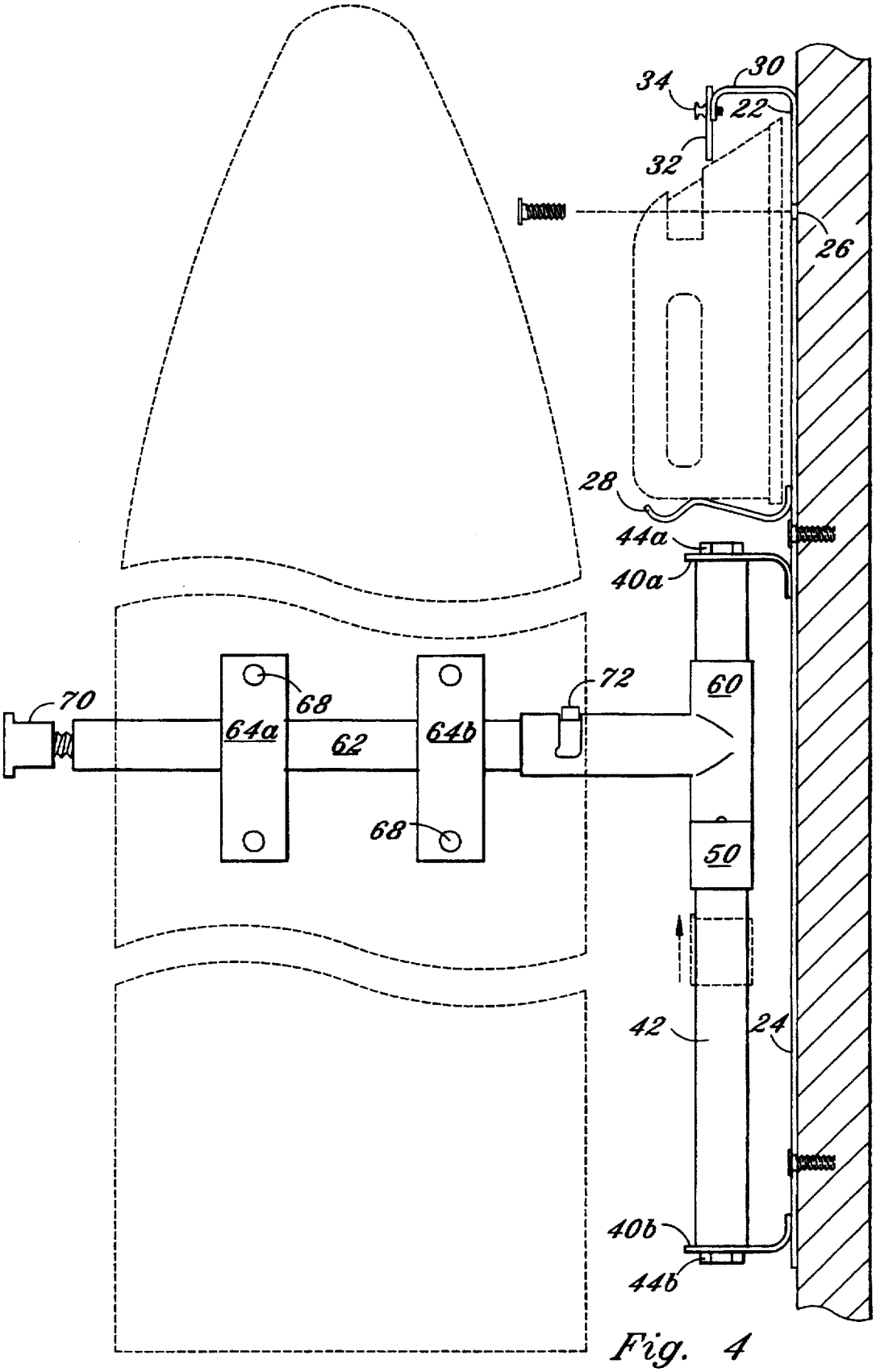
FIG. 4 shows a side elevational view of the instant invention with iron and ironing board shown in phantom.

With reference now to FIGS. 1–5, there is disclosed a preferred embodiment of the instant invention, which invention functions as ironing board and hand iron support and mounting bracket, generally referenced as 10. FIG. 1 shows the instant invention 10 having an ironing board and hand iron mounted thereon and depicted in phantom. Mounting bracket 10 includes an elongated, substantially rigid mounting plate 20 which includes an upper portion 22 adapted for supporting an iron, and a lower portion 24 adapted for supporting an ironing board. Mounting plate 20 further defines a plurality of apertures 26 for receiving fasteners therethrough for fixing plate 20 to a supporting surface such as a wall 12 as best depicted in FIG. 4.

As best depicted in FIGS. 1 and 4, mounting plate upper portion 22 includes an iron supporting flange 28 rigidly fixed to mounting plate 20 for supporting a hand-held iron as depicted in phantom. Mounting plate upper portion 22 terminates in a U-shaped end section 30, which end section incorporates a notched iron retaining flange 32 adjustably connected to end section 30 by a fastener such as a thumb screw 34. As is now apparent supporting flange 28 and retaining flange 32 cooperate to removably hold a hand iron (shown in phantom), whereby supporting flange 28 bears the weight of a hand iron while retaining flange 32 stabilizes a supported hand iron thereby securing the iron for safe and secure storage.

Mounting plate lower portion 24 includes a pair of brackets **40*a* and 40*b* rigidly fixed to mounting plate 20 and extending normal thereto. Brackets 40***a* and 40*b* support tubular member 42 as depicted in FIGS. 1–5. Each bracket 40*a* and 40*b* defines an aperture through which fasteners 44*a* and 44*b* are received for threadably engaging corresponding threaded bores (not shown) defined by the tubular member ends for fixedly securing tubular member 42 relative to mounting plate 20.

Figure 5:
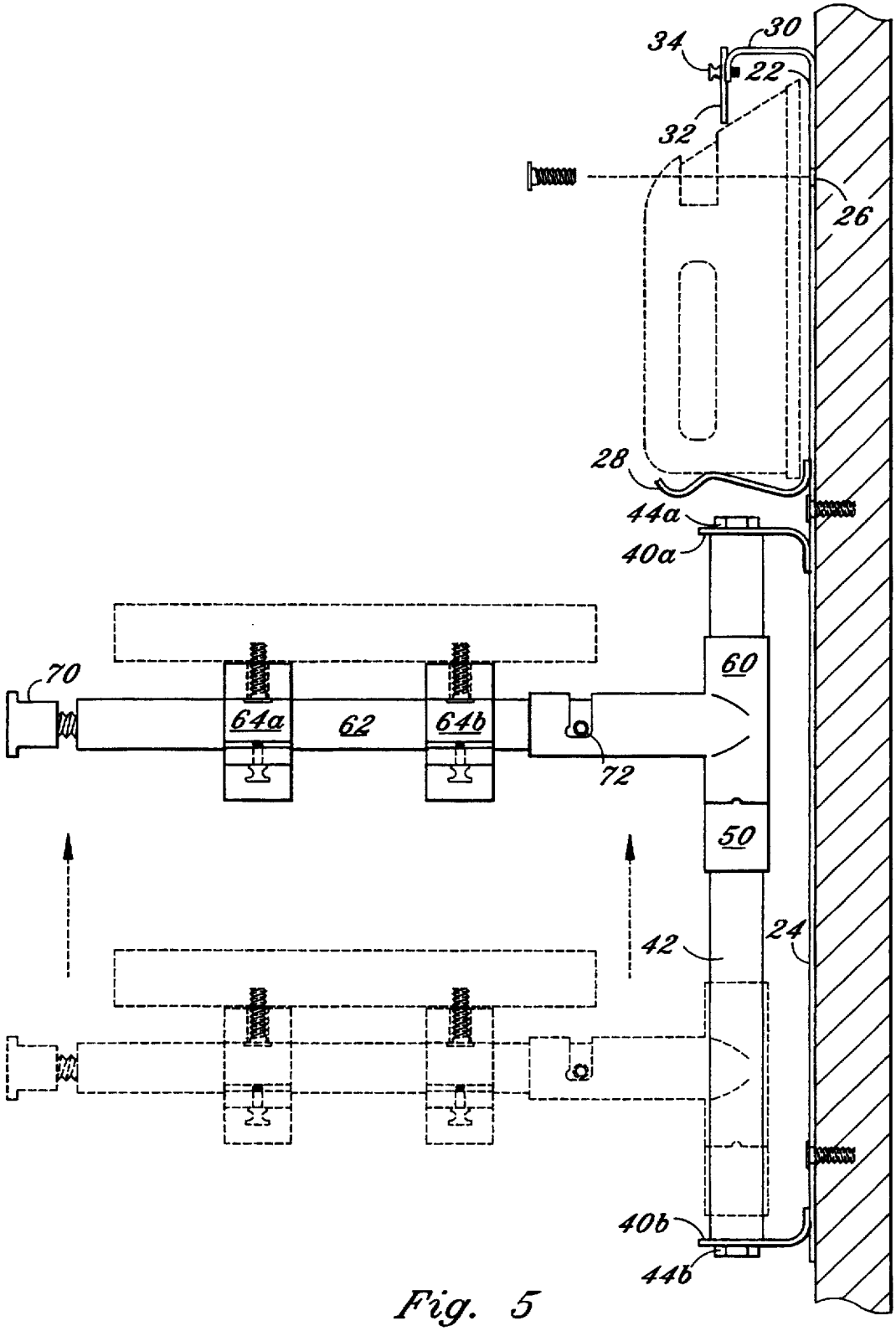
FIG. 5 shows a side elevational view of the instant invention with an ironing board shown in horizontal position in phantom.

First and second sleeve members, identified as 50 and 60 respectively, are slidably received over tubular member 42 thereby enabling vertical adjustment of sleeves 50 and 60 as best depicted in FIG. 5 and for reasons that will soon become apparent. A cylindrical horizontally extending ironing board support member 62 is rotatably supported by second sleeve member 60 such that ironing board support member 62 is cantileveredly supported by sleeve 60 and tubular member 42. In the preferred embodiment, sleeve 60 is T-shaped having a portion extending normal to the longitudinal axis of tubular member 42, which extending portion receives support member 62 rotatably therein for reasons that will soon become apparent.

A pair of ironing board brackets 64*a* and 64*b* are fixed to ironing board support member 62. Each ironing board bracket 64*a* and 64*b* define an aperture for receiving a portion of cylindrical ironing board support member 62 clamped therein as best depicted in FIGS. 2*a* and 2*b*. Clamping set screws 66 exert and maintain clamping pressure such that each ironing board bracket is fixed relative to support member 62. Brackets 64*a* and 64*b* each further define ironing board fastening apertures 68 for receiving ironing board fasteners therein for fixing an ironing board (shown in phantom) to brackets 64*a* and 64*b* as best illustrated in FIGS. 2*b* and 3 with the ironing board in phantom.

In association with ironing board support member 62 there is a hand knob 70 linked to a movable anchoring projection 72 which is received in a slot defined by a portion of T-shaped sleeve 60, whereby rotation of hand knob 70 causes anchoring projection 72 to engage a portion of sleeve 60 which defines the slot perimeter thereby anchoring support member 62 relative to sleeve 60. Thus, rotatable support member 62 may be anchored relative to sleeve 60 thereby enabling the user to fix the ironing board attached to brackets 64 to a vertical position for storage or a horizontal position for use. In addition, support member 62 may be rotated to, and fixed at, any suitable angled position for specialized pressing applications.

Vertical adjustment of an ironing board is accomplished via sleeve 50 which incorporates a threaded set screw for anchoring sleeve 50 relative to tubular member 42 at a user selected vertical position thereon. In an alternate embodiment, however, it may be desirable to include a set screw on sleeve 60 thereby eliminating the need for sleeve 50. Therefore, to vertically position the ironing board, the user simply raises the board to a suitable height, such that sleeve 60 slides along tubular member 42, and locks sleeve 60 by placing sleeve 50 adjacent thereto and locking sleeve 50 by rotating setscrew 52.

As is now apparent the instant invention provides an ironing board support enabling vertical height adjustment of an ironing board and two degrees of rotational freedom. For example, an ironing board may assume a storage position substantially adjacent and parallel to a supporting wall as depicted in FIG. 1. The ironing board may then be rotated away from the supporting wall in its vertically supported configuration as depicted in FIG. 4, and rotated to a horizontal position as depicted in FIG. 5. In addition, vertical adjustment is provided by sliding sleeve 60 along tubular member 42 to a user selected position and locking sleeve 60 in place using locking sleeve 50.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. A wall mountable bracket for supporting an ironing board and hand iron, said wall mountable bracket comprising:

an elongated, substantially planar, rigid plate having a top portion and a bottom portion, said rigid plate adapted for wall mounting;

said plate top portion defining means for supporting a hand held iron including a supporting flange for bearing the weight of an iron thereon, and a retaining flange for engaging a portion of an iron supported by said supporting flange;

said plate bottom portion incorporating means for adjustably supporting an ironing board and for enabling adjustment of an ironing board vertically and in two degrees of rotational freedom.

2. A wall mountable bracket according to claim 1, wherein said means for adjustably supporting an ironing board comprises a vertically disposed tubular supporting member fixed to said rigid plate, and a sleeve member slidably and rotatably received on said tubular member, said sleeve member having a horizontally extending portion adapted for supporting an ironing board thereon.

3. A wall mountable bracket according to claim 2, wherein said sleeve member horizontally extending portion includes a section rotatable about a horizontal axis, said section including means for mounting an ironing board.

4. A wall mountable bracket for supporting an ironing board and hand iron, said wall mountable bracket comprising:

an elongated substantially planar rigid plate having a top portion and a bottom portion, said rigid plate defining a plurality of apertures for receiving mounting fasteners therein;

said plate top portion including a projecting flange for supporting a hand iron thereon and an iron retaining flange, spaced from said rigid plate, for stabilizing an iron supported by said projecting flange;

said plate bottom portion including tubular member fixed to said plate in spaced relation therewith and having a vertically disposed longitudinal axis;

a tubular T-shaped member slidably received on said tubular member and rotatably positionable thereon, said T-shaped member having a horizontally extending tubular portion;

a cylindrical ironing board support member rotatably received within said horizontally extending tubular portion, said ironing board support member including means for mounting an ironing board thereon;

means for selectively anchoring said T-shaped member relative to said tubular member at a user selected vertical position thereon;

means for anchoring said cylindrical ironing board support member relative to said T-shaped member portion thereby securing said means for mounting an ironing board at a user selected angle.

5. A wall mountable bracket according to claim 4, wherein said means for anchoring said cylindrical ironing board support member includes a slot defined by said T-shaped member horizontally extending portion and a projecting member connected to said cylindrical ironing board support member and received within said slot, said projecting member linked to a knob whereby rotation of said knob causes said projecting member to engage said T-shaped member horizontally extending portion thereby locking said cylindrical support member relative to said T-shaped member.

6. A wall mountable bracket according to claim 4, wherein said means for selectively anchoring said T-shaped member relative to said tubular member comprises a hand actuated set screw.

7. A wall mountable bracket according to claim 4 further including means for rotationally anchoring said T-shaped member relative to said tubular member.

8. A wall mountable bracket for supporting an ironing board and hand iron, said wall mountable bracket comprising:

an elongated substantially planar rigid plate having a top portion and a bottom portion, said rigid plate defining a plurality of apertures for receiving mounting fasteners therein;

said plate top portion including a projecting flange for supporting a hand iron thereon, said top portion terminating in a arcuate end having an iron retaining flange adjustably mounted thereon and spaced from said rigid plate, said retaining flange for stabilizing an iron supported by said projecting flange;

said plate bottom portion having a tubular member fixed thereto and in spaced relation therewith, said tubular member supported by a pair of brackets attached to said plate, said tubular member having a vertically disposed longitudinal axis;

a tubular T-shaped member slidably received on said tubular member and rotatably positionable thereon, said T-shaped member having a horizontally extending tubular portion;

a sleeve member slidably received on said tubular member and disposed below said tubular T-shaped member, said sleeve member including a set screw means for locking said sleeve member relative to said tubular member at a user selected vertical position whereby said sleeve member supports said T-shaped member at a selected vertical position on said tubular member;

said sleeve member having at least one protruding portion defined by an upper circumferencial periphery thereof, said T-shaped member having at least one recessed portion defined by a lower circumferencial periphery thereof, said protruding portion and said recessed portion cooperating to fix said T-shaped member at a first rotational position wherein said T-shaped member horizontally extending tubular portion is substantially parallel to the supporting wall surface, and a second rotational position wherein said T-shaped member horizontally extending tubular portion is substantially perpendicular to the supporting wall surface;

a cylindrical ironing board support member rotatably received within said T-shaped member horizontally extending tubular portion, said horizontally extending tubular portion defining a slotted aperture, said ironing board support member having a projecting member linked to a knob whereby rotation of said knob causes said projecting member to engage said horizontally extending portion thereby locking said cylindrical support member relative to said T-shaped member;

said ironing board support member having a pair of ironing board mounting brackets attached thereto thereby facilitating rigid attachment of an ironing board thereto.

* * * * *